United States Patent [19]

Philip

[11] 4,180,993

[45] Jan. 1, 1980

[54] SINKER-NEEDLE MOTION REDUCER

[76] Inventor: Morris Philip, c/o Philip Knitting Mill, 26 Bruckner Blvd., Bronx, N.Y. 10454

[21] Appl. No.: 950,727

[22] Filed: Oct. 12, 1978

Related U.S. Application Data

[63] Continuation of Ser. No. 737,672, Nov. 1, 1976, abandoned.

[51] Int. Cl.[2] ..... D04B 15/06; D04B 15/24

[52] U.S. Cl. ..... 66/107

[58] Field of Search ..... 66/8, 107, 108 R, 108 A

[56] References Cited

U.S. PATENT DOCUMENTS

| | | | |
|---|---|---|---|
| 925,036 | 6/1909 | Scott | 66/107 |
| 1,534,785 | 4/1925 | Houseman | 66/107 |
| 1,539,568 | 5/1925 | Houseman | 66/107 |
| 1,770,469 | 7/1930 | Grieve | 66/107 X |
| 1,882,430 | 10/1932 | Lawson | 66/108 R |
| 2,052,777 | 9/1936 | Lawson | 66/108 R X |
| 2,101,005 | 11/1937 | Lawson | 66/108 R X |
| 2,761,302 | 9/1956 | Nebel | 66/108 R |
| 3,430,463 | 3/1969 | Nebel et al. | 66/108 R X |
| 3,837,185 | 9/1974 | Havranek et al. | 66/107 |

FOREIGN PATENT DOCUMENTS

| | | | |
|---|---|---|---|
| 2311658 | 9/1973 | Fed. Rep. of Germany | 66/107 |

*Primary Examiner*—Wm. Carter Reynolds

[57] ABSTRACT

A method and apparatus for drawing and knitting yarn on a circular knitting machine which includes a needle cylinder, a sinker ring fixedly mounted on the cylinder and having a plurality of equally spaced, radially extending sinker grooves. Each groove contains a sinker having a step on its bottom surface adjacent the cylinder end of the sinker. The ring includes a well adjacent the needle cylinder and a shelf between the well and the sinker grooves. A cam occurs on the ring for sequentially moving the sinkers, one after the other, radially toward and radially away from the cylinder so that the bottom surfaces and steps on the sinkers engage the bottom surface and shelf of the sinker groove when the sinkers are moved radially inward to lower the needle cylinder end of each sinker and to raise the needle cylinder end of the sinker when the sinkers are moved radially outward. A guide is on the cam for engaging the sinker and guiding the sinker downwardly to engage the sinker step in the sinker ring well. A throat is on the sinker for engaging and holding the knitted fabric when the sinker is moved radially inward, the throat extending rearwardly and angularly relative to the sinker. In practicing the method of operating the apparatus the needle end of each sinker is raised as adjacent needles move downward and is lowered as adjacent needles move upward.

11 Claims, 8 Drawing Figures

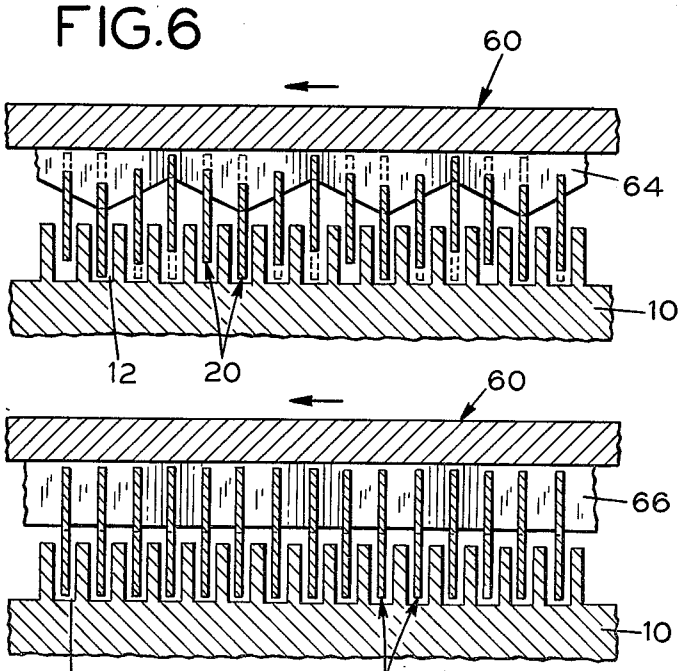
FIG.6
FIG.7
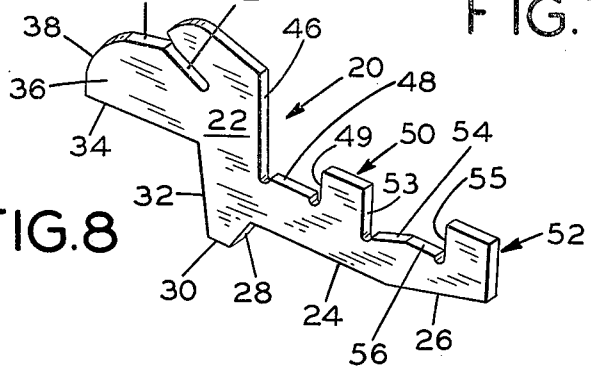
FIG.8
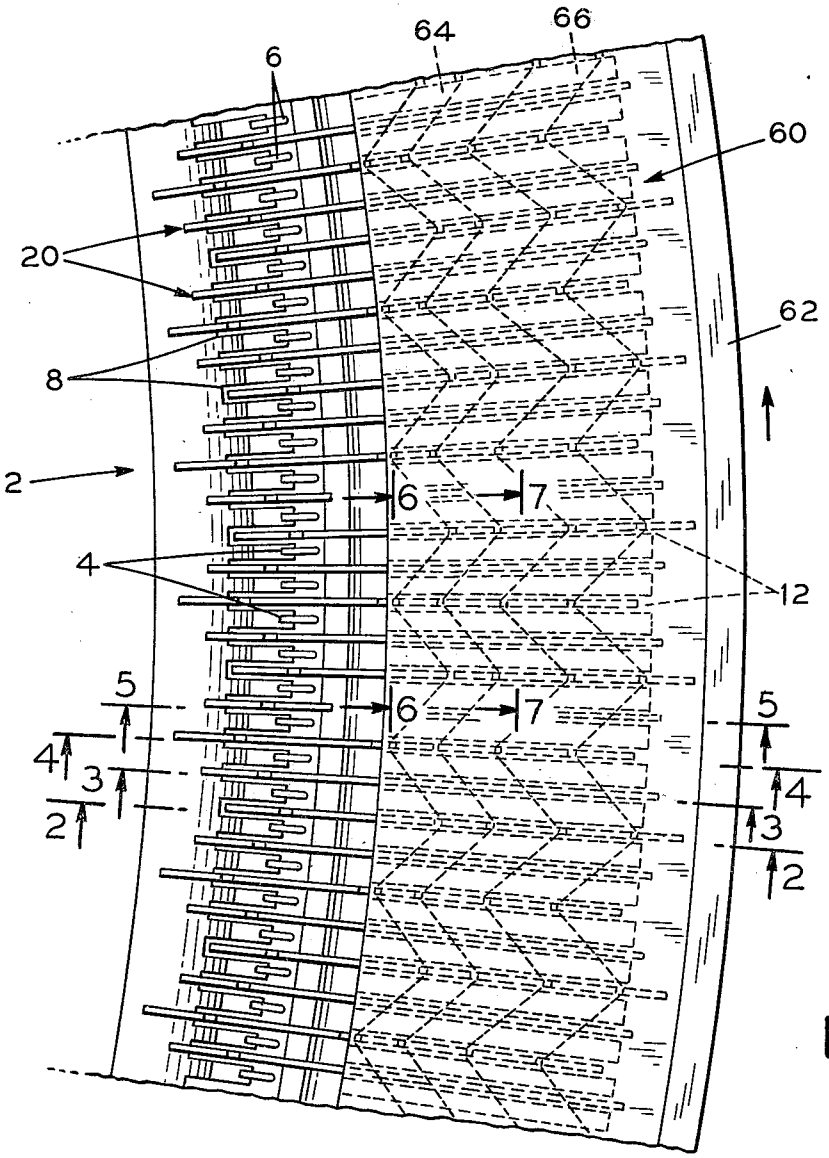
FIG.1

SINKER-NEEDLE MOTION REDUCER

This is a continuation of application Ser. No. 737,672 filed Nov. 1, 1976, now abandoned.

This invention relates to a method and apparatus for knitting and, more particularly, to a method and apparatus for knitting in which a circular knit machine having cooperating needles and sinkers is employed.

It is common practice, in the knitting of fabric on circular knitting machines, to utilize alternately arranged needles and sinkers to draw and knit yarn into knitted fabric. In such machines, the needles are arranged in grooves around a cylinder and the sinkers are arranged in grooves in a sinker ring mounted on the cylinder. The needles are reciprocated vertically in the cylinder needle grooves by cams while the sinkers are moved radially between the reciprocating needles. As the needles reciprocate, the needle hooks engage the yarn to be knitted and draw such yarn from the yarn source across the sinkers.

Through the cooperative movement of the needles and sinkers, the yarn is knitted into fabric. In moving radially back and forth between the needles, the sinkers hold the yarn as the needles reciprocate down and draw and form the yarn into stitches. The sinkers hold the fabric as the needles reciprocate upward. To facilitate such holding of the fabric, each sinker is provided with a throat or slot into which the knitted fabric slides and is held as the sinker is moved radially inward toward the needle cylinder, between the needles, and the needles reciprocate upward.

It has long been recognized that the length of upward and downward movement or length of reciprocal movement of the needles might be reduced if the sinkers, along with their radial movement, might also be reciprocated upwardly and downwardly in a direction opposite to the direction of needle reciprocation. In such arrangement, the yarn is drawn and formed into stitches by the concurrent, opposite directions of movement of the needles and sinkers.

Attempts to provide upward and downward sinker movement have, heretofore, met with only limited success. Such attempts have involved complicated mechanisms, costly and precise adjustments, have resulted in uneven wear and damage to the apparatus and, more important, have failed to provide the even and uniform motion required for uniformity of stitches in the fabric produced. The lack of uniformity in sinker motion has resulted in uneven yarn draw and uneveness in stitch formation which detract from the fabric appearance.

The foregoing and many other difficulties heretofore encountered in attempts to provide sinker reciprocation in circular knit machines are overcome in the instant invention. This is accomplished by novel sinker configuration combined with relatively simple radial and reciprocal motion of the sinkers. The sinkers are moved radially inwardly and outwardly by cams held in fixed position as the sinkers and needles rotate with the sinker ring and needle cylinder, respectively. Conversely, the sinker ring and needle cylinder, with the sinkers and needles, might be held fixed while the cams rotate. In either event, the sinkers are moved radially inwardly and outwardly while the needles are reciprocated upwardly and downwardly.

Each sinker, in the instant invention, is moved radially inwardly and outwardly by a sinker cam. Each sinker has a downwardly projecting surface, adjacent the needle cylinder end of the sinker, which engages a surface at the needle cylinder end of the sinker groove. As the sinker is drawn radially outwardly and advanced radially inwardly in the sinker groove by the sinker cam, the downwardly projecting surface on the sinker, in engagement with the sinker groove surface, raises the end of the sinker adjacent the needle. Thus the needle end of the sinker is reciprocated upwardly relative to the reciprocating needle. The direction of reciprocal movement of the sinker is opposite to the reciprocating direction of the needle. Hence, when the needle is reciprocated downwardly, the sinker is reciprocated upwardly, and vice versa.

The contact areas of the sinker cams and sinker grooves are treated and hardened. It has been found particularly useful, for reasons more apparent hereinafter, to extend the sinker ring surface at the needle end of the sinker grooves beyond such groove to form a shelf, flush with the bottom surface of the groove, for supporting the sinkers while the stitches are being drawn by the needle and to carbide the surface of such shelf where the downwardly projecting surface of the sinkers rest on such shelf during such needle drawing. With other types of hardening, the needle grooves might be extended toward the needle cylinder and the shelf eliminated.

As already noted, as the needles reciprocate down to draw and form the yarn into stitches, the sinkers in the instant invention hold the yarn. To accomplish this, as the needle engages the yarn and is being reciprocated downwardly, the sinker immediately behind such needle is drawn radially outwardly in a direction away from the needle cylinder. As such sinker moves radially outwardly, the downwardly projecting surface of the sinker at the sinker end adjacent the needle cylinder engages the sinker ring shelf. This engagement of the sinker and shelf, as the sinker is being drawn outwardly, raises or elevates the needle end of the sinker, causing the sinker, as it is raised or elevated, and the needle, as it reciprocates downward, to draw the yarn from the source and to form such drawn yarn into a stitch of a precise length. Because such sinkers are all of the same height, the length of stitch drawn by each needle and sinker combination is the same as the length of stitch drawn by the other needles and sinkers. Thus, the knit fabric produced is uniform. By changing all of the sinkers with new sinkers when replacement becomes necessary, uniformity of the fabric knitted is maintained.

The present invention will be more fully understood from the following description and appended drawings of a preferred embodiment in which FIG. 1 is a top plan view showing a portion of the needle cylinder and sinker ring of a circular knit machine embodying the instant invention;

FIG. 6 is a view, partly in section, taken at 6—6 in FIG. 1, showing the sinkers and sinker guides, with the sinkers at various stages of operation;

FIG. 7 is a view, partly in section, taken at 7—7 in FIG. 1, showing the sinkers and sinker cams, with the sinkers at the various stages of operation of FIG. 6; and FIG. 8 is a perspective view of the sinker of the preferred embodiment of the invention.

Figure 3:
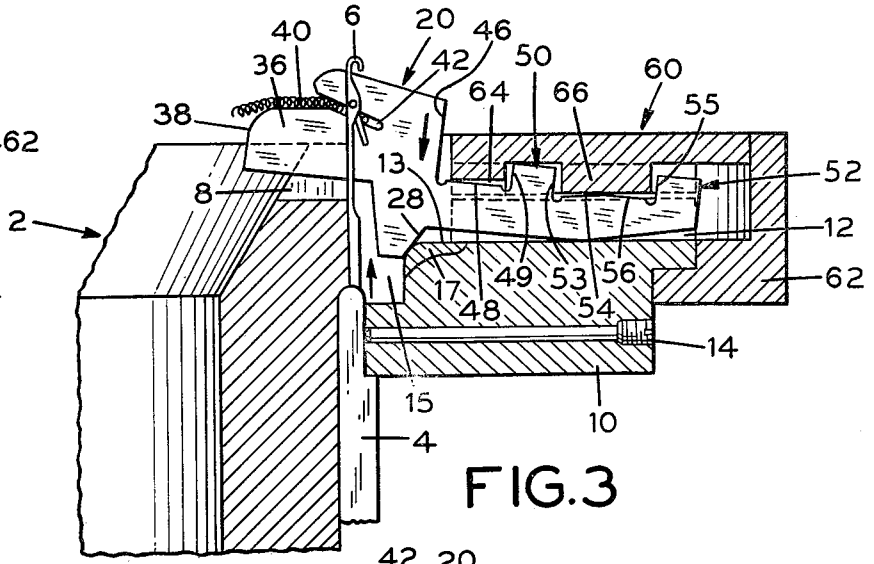
FIGS. 2, 3, 4 and 5 are section views taken at 2—2, 3—3, 4—4 and 5—5, respectively, in FIG. 1, showing the needle and sinker mechanisms at various stages of operation.

Referring to the drawing, the needle cylinder, generally designated 2, has a plurality of needle grooves 4, spaced equally around the outer periphery of the cylinder. Each groove 4 contains a needle 6, FIGS. 2-5, mounted for reciprocation upwardly and downwardly in groove 4 by engagement, in conventional manner, of the needle butt with the needle cam, not shown. The needles may be of the latch type, as shown in FIGS. 2-5, or of any other type suitable for use on a circular knit machine.

Cylinder 2, at its upper end intermediate each of the needle grooves 4 and needles 6, is provided with equally spaced sinker slots 8. The purpose of such sinker slots and the positioning thereof will be more apparent from the description hereinafter.

Sinker ring 10, having sinker grooves 12, is mounted by set screws 14 on needle cylinder 2 and is locked thereto for rotation therewith by the set screws. Each sinker groove 12 contains a sinker, generally designated 20, mounted for sliding, radial movement along the bottom wall and between the side walls of sinker grooves 12. The needle cylinder end of sinker grooves 12 terminate in a shelf 13 and well 15 which extends circumferentially around sinker ring 10 at the needle cylinder end of sinker grooves 12 where sinker ring 10 is mounted on needle cylinder 2. For reasons which will be more apparent hereinafter, the end and surface of shelf 13 is hardened at 17 by, for example, carbiding.

As best shown in FIGS. 2-5 and 8, sinkers 20 each include a blade 22 having a straight, median bottom edge 24, an upwardly sloping rear bottom edge 26, a downwardly sloping forward bottom edge 28, a step 30 and an edge 32 forward of step 30 sloping upwardly to the most forward bottom edge 34 under sinker nose 36 at needle cylinder 2 end of sinkers 20. Sinker nose 36, at the needle end of sinker 20, has a rounded forward edge 38, a substantially flat upper edge 40 and downwardly sloping throat 42. For reasons more fully explained hereinafter, the surfaces of upper edge 40 and step edge 30 are substantially parallel. Behind throat 42, the top edge of sinker 20 extends substantially vertically downward, at 46, to a substantially horizontal guide surface 48 between vertical edge 46 and vertical wall 49 of upwardly extending forward butt 50. Rear butt 52 extends upwardly from the rear end of sinker 20. Cam surfaces 54, 56, angled at a slight angle relative to each other for reasons more apparent hereinafter, extend along the top edge of sinker 20 between butts 50,52. Rear wall 53 of forward butt 50 and front wall 55 of rear butt 52 extend substantially vertically and, with surfaces 54,56, form a cam receiving opening.

Needle cylinder 2, with needles 6 mounted for sliding reciprocal movement therein, and sinker ring 10 mounted on and fixed to needle cylinder 2 by set screws 14 and having sinkers 20 mounted thereon for radial, reciprocal movement toward and away from cylinder 2 between needles 6, are mounted for rotational movement in conventional manner. Sinker guide and cam member, generally designated 60, is fixed to support 62 attached by means, not shown, to a stationary member of the circular knit machine frame. Thus, sinker guide and cam member 60 remains stationary while needle cylinder 2 and sinker ring 10 rotate. As already noted, the needle cylinder and sinker ring might be held stationary in which event guide and cam member 60 would be mounted to rotate with the needle cam.

Sinker guide and cam member 60 has, at its needle end, sinker guide 64 and, intermediate its ends, sinker cam 66. As best shown in FIG. 1, sinker guide 64 and sinker cam 66 extend circumferentially at the bottom surface of member 60 and are substantially parallel to each other each in the form of a chain of interconnected "V"'s in a plane perpendicular to the axis of needle cylinder 2. As best shown in FIGS. 6 and 7, each of the "V" segments of sinker guide 64 are also in the form of interconnected "V"'s in the vertical direction, parallel to the axis of needle cylinder 2. Sinker cam 66, in such vertical plane, project downwardly from member 60 a substantially constant and uniform distance.

In the illustrated embodiment of the invention, needle cylinder 2, with needles 6 and sinker ring 10 with sinkers 20 rotate about the axis of cylinder 2 while the needle cam, not shown, and guide and cam member 60 with guide 64 and cam 66 thereon are held stationary. It is to be understood, however, that the rotating and stationary members might be reversed.

With needle cylinder 2 and sinker ring 10 rotating, needles 6 are raised and lowered, in conventional manner, progressively around cylinder 2 as needle cylinder 2 rotates. Depending upon the diameter of the needle cylinder and the number of needles a plurality of contiguous needles are at various positions of upward advancement toward yarn engaging position and a plurality of contiguous needles are, at the same time, at various positions of downward advancement in yarn draw and stitch formation. For purposes of illustration of the instant invention but without limiting the number of contiguous needles at various positions between the fully advanced upward position and the fully retracted downward position, the instant invention is illustrated and described with respect to four contiguous needles with the immediately following sinker. Such four contiguous needles at the respective operation positions, with the immediately following sinkers, are illustrated in FIGS. 2-6.

Figure 2:
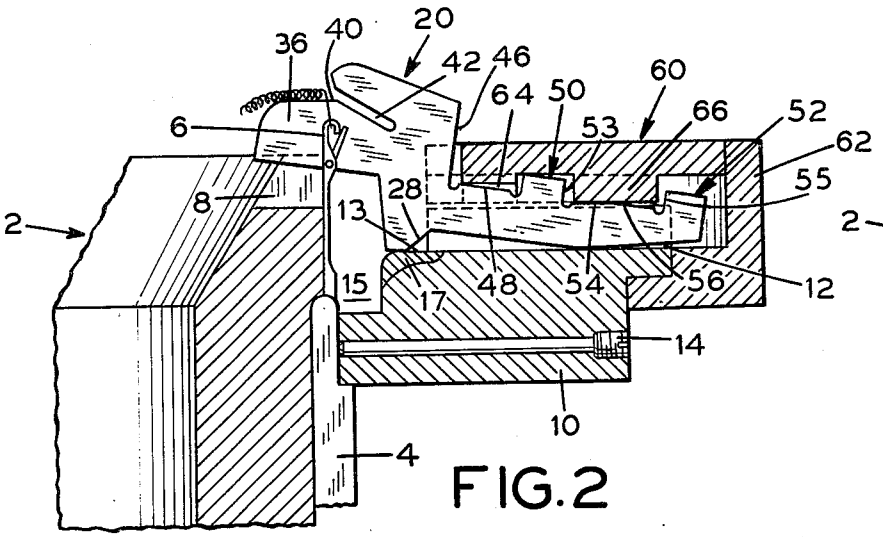

Referring first, to FIG. 2, needle 6 is fully down, sinker 20 is fully retracted, the yarn being knitted is engaged by the needle hook and has been drawn by needle 6 and sinker 20 as needle 6 was reciprocated downward and sinker 20 was retracted radially outward. In such position, as shown in FIG. 2, step edge 30 is on the hardened surface 17 of sinker shelf 13 and flat upper edge 40 is elevated and supporting the knitted fabric and drawn yarn. As already described, the surface of upper edge 40 and the surface of step edge 30 are substantially parallel. Thus, with step edge 30 resting on hardened surface 17 of sinker shelf 13, the distance from the hook end of needle 6 to upper edge 40 is substantially constant irrespective of any variation which might occur in the retraction of sinker 20 away from needle cylinder 2.

As best shown in FIGS. 1, 2 and 6, with needle 6 fully down and sinker 20 fully retracted from needle cylinder 2, sinker butts 50, 52 are retracted into the valley between the contiguous, interconnected "V" segments of sinker guide 64 and sinker cam 66. Cam surface 54 of sinker 20 is in engagement with cam 66. Guide surface 48 of sinker 20 is elevated into the valley between the contiguous, interconnected "V" segments of sinker guide 64 in the vertical plane, FIG. 6.

Needle cylinder 2, with sinker ring 10 affixed thereto, is rotating about its axis in the direction of the arrows, FIGS. 1, 6 and 7. As needle cylinder 2 rotates in such direction from the position of FIG. 2 to the position of FIG. 3, the needle cam, not shown, in contact with the needle butt on needle 6 elevates such needle. As needle 6 is elevated, sinker cam 66 in contact with sinker 20 between vertical sinker butt walls 53,55 advances sinker 20 radially inwardly, toward needle cylinder 2. As sinker 20 is advanced radially inwardly, sinker step 30 slides off of shelf 13 and, by gravity and the engagement of walls 53,55 with cam 66, the needle end of sinker 20 moves downward. To asure such downward movement of sinker 20, horizontal guide surface 48 forward of sinker butt 50 is in engagement with the downwardly sloping side wall of the vertically "V" shaped surface of sinker guide 64, causing the needle end of sinker 20 to move downwardly should resistance to the gravity and movement by cam 66 occur.

Figure 4:
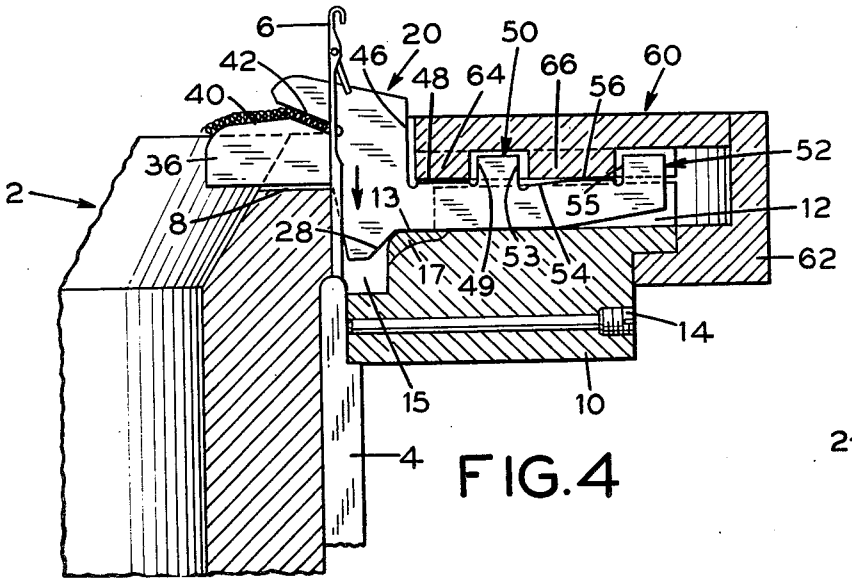

Needle cylinder advances to and through the position shown in FIG. 3 and into and through the position shown in FIG. 4. In the position shown in FIG. 4, needle 6 is fully elevated, the needle latch is open and sinker 20 is fully advanced radially inward toward needle cylinder 2. In such radially inward position, vertical sinker butt walls 53,55 are in engagement with the vertical walls of sinker cam 66 at the apex of the "V". Cam surface 56 on sinker 20 between butt walls 53,55 is in engagement with the bottom, facing surface of sinker cam 66 and median bottom edge 24 of sinker 20 is in engagement with the bottom wall of sinker groove 12. Step 30 of sinker 20 is in sinker ring well 15. As best shown in FIG. 4, with sinker 20 in its fully advanced radially inward position with its needle end in the full downward position, throat 42 of sinker 20 slopes downwardly and backwardly from yarn engaging upper edge 40 of sinker 20. By sloping such throat downwardly and backwardly from edge 40, the vertical clearance between the inner end of throat 42 and the opened latch of needle 6 is increased, better assuring that the stitch in the needle will clear the latch as the needle advances upwardly and the latch is opened by the knitted fabric and yarn held in throat 42 of sinker 20.

Figure 5:
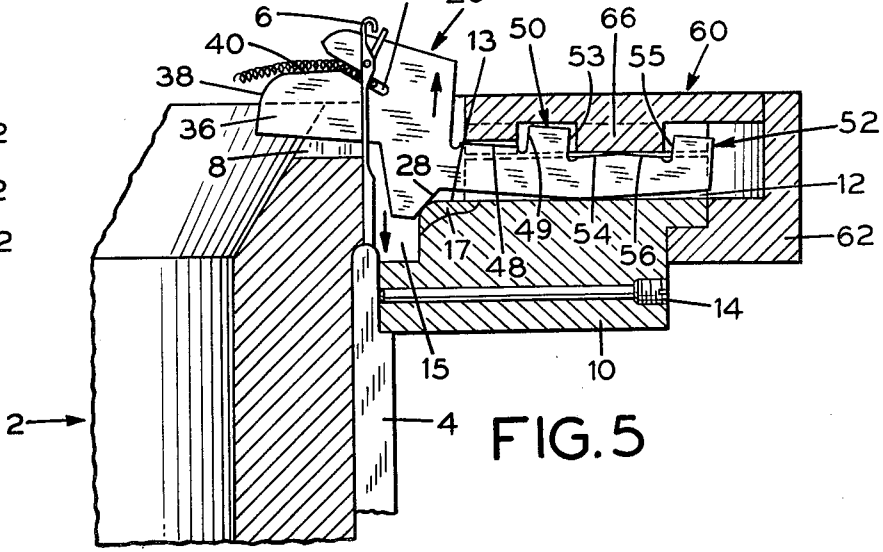

The hook end of needle 6, with the needle in the fully advanced position of FIG. 4 and with the needle latch open, engages the yarn being fed to the machine and being knitted into the fabric and, as the needle reciprocates downwardly into and through the position of FIG. 5, draws such engaged yarn into the fabric. As needle 6 is reciprocated downwardly by the cooperating needle butt and needle cam, not shown, sinker 20 is retracted radially outwardly from needle cylinder 2 and the needle end of sinker 20 is again elevated relative to the downwardly moving needle. Thus, as best shown in FIGS. 1, 5, 6 and 7, the outwardly angled side walls of "V" shaped element of cam 66 engage vertical side walls 53, 55 of sinker butts 50, 52, drawing sloping bottom edge 28 of sinker 20 upwardly on hardened surface 17 of sinker shelf 13. The needle end of sinker 20 is tipped upwardly, relative to downwardly moving needle 6, by the engagement of the angled side walls of cam 66 with vertical side walls 53,55 of sinker butts 50,52, raising straight, median bottom edge 24 off of the bottom wall of sinker groove 12 and bringing upwardly sloping rear bottom edge 26 of sinker 20 downwardly toward the bottom wall of the sinker groove. As all of this is occurring, the needle end of sinker 20 continues to rise relative to downwardly moving needle 6.

Needle cylinder 2 and sinker ring 10 rotate into and through the position in FIG. 5. The cycle of upward and downward movement of needles 6 and radial inward and outward movement of sinkers 20, together with the upward and downward movement of the needle end of sinkers 20 as such sinkers move radially upward and outward is repeated at each "V" shaped sinker guide and cam segment. Thus, the fabric is circularily knitted in a continuous sequence of knit stitches, progressively knitted, one after the other, by the needles and sinkers moving through the cycle described.

Sinkers 20, as has already been noted, are all of the same size, at least between the substantially parallel surfaces of step edge 30 and upper edge 40. Thus, each sinker and each needle, as it reaches the position shown in FIG. 2, will cause the same length of feed yarn to be drawn. Because such length of drawn feed yarn determines the length of stitch which is knitted, the length of knitted stitches knitted by each of the needles and sinkers is the same as knitted with the other needles and sinkers. This results in a uniformly knit fabric.

The movement of the sinkers relative to the sinker cams and the movement of the sinkers in the sinker grooves are of the same type as the movement of the needles relative to the needle cams and needle grooves. Thus, the wear which will occur at the sinkers is comparable to wear occurring at the needles. Because such wear is substantially uniform and constant, as the sinkers wear the stitch formation will remain uniform and all of such sinkers might be replaced at the same time as all of the needles are replaced.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A circular knitting machine having a needle cylinder, independently movable needles mounted on said cylinder for longitudinal, reciprocal movement on said cylinder, a sinker ring fixedly mounted on said cylinder, said sinker ring having a plurality of equally spaced sinker grooves extending radially across the upper surface of said sinker ring, a well in said upper surface of said ring adjacent said mounting of said ring on said needle cylinder, a shelf between said well and the cylinder end of said sinker grooves, said well and said shelf extending circumferentially around said cylinder with the surface of said shelf and the bottom surface of said sinker grooves aligned, a sinker in each of said grooves and cam means for sequentially moving said sinkers, one after the other, radially toward and radially away from said cylinder, each of said sinkers having a bottom surface for engagement with the surface of said shelf and bottom surface of said sinker groove when said sinker is moved radially inward toward said needle cylinder and a step portion extending downwardly from said bottom surface for engagement in said well when said sinker is moved radially inward toward said needle cylinder and for engagement with the surface of said shelf when said sinker is moved radially outward away from said needle cylinder.

2. A circular knitting machine, as recited in claim 1, in which said cam means includes spaced butt means on said sinker and a cam mounted in fixed position relative to said sinkers and said butts for engaging said butts for moving said sinkers radially toward and radially away from said cylinder.

3. A circular knitting machine, as recited in claim 2, in which said cam means further includes guide means for engaging said sinkers forward of said butts and for guiding said sinkers downwardly as said sinkers are moved radially toward said cylinder for engaging said step portion of said sinkers in said well in said sinker ring.

4. A circular knitting machine having a needle cylinder, independently movable needles mounted on said cylinder for longitudinal, reciprocal movement on said cylinder, a sinker ring fixedly mounted on said cylinder, independently movable sinkers mounted on said sinker ring for reciprocal movement on said sinker ring in a direction radial to said cylinder, means for reciprocating said sinkers and stationary means on said sinker ring adjacent said needles for engagement with means on said sinkers for raising the ends of said sinkers adjacent such needles as said sinkers are reciprocated in said radial direction away from said cylinder and for lowering the ends of said sinkers adjacent such needles as said sinkers are reciprocated in said direction toward said cylinder, each of said sinkers having a first surface for engaging the yarn being knitting as the sinker is reciprocated away from said cylinder and the needle end of said sinker is raised and a throat for engaging and holding the knitted fabric as the sinker is reciprocated toward said cylinder and the needle end of said sinker is lowered, said throat slanting downwardly and rearwardly from said yarn engaging first surface when said sinker is reciprocated toward said cylinder and the needle end of said sinker is lowered.

5. A circular knitting machine, as recited in claim 4, in which said means for reciprocating said sinkers includes a cam for moving said sinkers radially toward and radially away from said cylinder.

6. A circular knitting machine, as recited in claim 5, in which said cam includes a plurality of interconnected "V" shaped segments extending on said sinker ring circumferentially around said cylinder.

7. A circular knitting machine, as recited in claim 4, in which said means on said sinker ring for engagement with means on said sinkers includes a well and a shelf on said sinker ring adjacent to the mounting of said sinker ring on said cylinder.

8. A cylinder knitting machine, as recited in claim 6, in which said means on said sinker ring for engagement with means on said sinkers includes a well and a shelf on said sinker ring adjacent to the mounting of said sinker ring on said cylinder.

9. A circular knitting machine, as recited in claim 4, in which said sinker ring includes a plurality of equally spaced, radial sinker grooves, each of said grooves forming a guideway in said sinker ring for the individual of said independently movable sinkers.

10. A circular knitting machine, as recited in claim 8, in which said sinker ring includes a plurality of equally spaced, radial sinker grooves, each of said grooves forming a guideway in said sinker for the individual of said independently movable sinkers.

11. A circular knitting machine, as recited in claim 10, in which each of said sinkers includes a first surface for engaging the yarn being knitted as the sinker is reciprocated away from said cylinder and the needle end of said sinker is raised and a throat for engaging and holding the knitted fabric as the sinker is reciprocated toward said cylinder and the needle end of said sinker is lowered.

* * * * *